United States Patent [19]

Robertsen

[11] Patent Number: 4,690,566

[45] Date of Patent: Sep. 1, 1987

[54] PROGRAMMABLE TIMING DEVICE

[75] Inventor: Anthony L. Robertsen, Anaheim Hills, Calif.

[73] Assignee: Elite Concepts, Inc., Laguna Niguel, Calif.

[21] Appl. No.: 939,406

[22] Filed: Dec. 8, 1986

[51] Int. Cl.[4] ..... G04B 23/12

[52] U.S. Cl. ..... 368/108; 368/187

[58] Field of Search ..... 368/69-70, 368/107-110, 185-187; 340/309.5

[56] References Cited

U.S. PATENT DOCUMENTS

| | | | |
|---|---|---|---|
| 3,778,809 | 12/1973 | Hawes | 340/309.5 |
| 4,234,051 | 11/1980 | Morris et al. | 180/272 |
| 4,240,071 | 12/1980 | Ochiai | 180/287 |
| 4,520,351 | 5/1985 | Altman et al. | 340/374 |
| 4,543,568 | 9/1985 | Hwang | 340/528 |

*Primary Examiner*—Vit W. Miska

[57] ABSTRACT

A programmable timing device adapted to be programmed to produce a signal after expiration of one or a multiple of timing periods. Each actuation of a programming switch representing one such timing period. And a lockout circuit effective to limit the time within which the programming switch is effective to program the device.

4 Claims, 3 Drawing Figures

PROGRAMMABLE TIMING DEVICE

FIELD OF THE INVENTION

The present invention relates to a programmable timing device and particularly, a programmable timing device where the program cannot be altered after the program starts to run.

BACKGROUND OF THE INVENTION

The prior art is replete with programmable timing devices. The best example is the common watch or clock which can be programmed to sound an alarm at a time programmed in by the operator. However, with such watches and clocks, the program can be changed at any time at the option of the operator or any other person.

The prior art also discloses delay circuits in alarm devices. U.S. Pat. No. 4,520,351 discloses an alarm system having a circuit which delays activation of an alarm circuit, to take corrective action upon accidental activation of the alarm device. However, the system is not programmable.

U.S. Pat. No. 4,234,051 discloses a driver alertness device enabling the driver to program in a time interval. Before expiration of the time interval, the driver must reprogram or warning signals will be given and the engine will be throttled back. A delay circuit is provided to produce a time interval between when the warning signal is given and the engine is affected, to enable the driver to regain control. There is no interrelationship between the functions of the programming by the driver and the time delay.

U.S. Pat. No. 4,240,071 discloses a time delay in the starter/ignition circuit of a vehicle wherein the operator must perform successfully some feat for a specified period of time before the engine can start. No programming is involved as the time delay is preset.

U.S. Pat. No. 3,778,809 discloses an alarm circuit which is programmable to different time periods. The circuit provides for deactivation of the alarm prior to expiration of the programmed time period. There is no time delay associated with the programming function.

U.S. Pat. No. 4,543,568 discloses time period delays in an alarm system between when the system goes on "stand-by" and full activation, permitting the user of the system to perform various functions during the time delays. There is no programming of the system by the user as a function of the systems use.

SUMMARY OF THE INVENTION

The present invention provides a device adapted to be programmed for each use thereof and, after a designed interval of time from when the program is initiated, the program cannot be modified. Thus, the device can be used to provide a signal after a desired interval of time, and the interval of time cannot be modified nor the signal prevented by manipulation of the device by an unauthorized activity. The ultimate uses of the invention are limited to the imagination of those skilled in the art. Suggested uses could include identifying property taken from its proper place beyond a specified period of time, or alarm or warning devices advising persons unable, for any reason, that a specified period of time has passed.

As a specific example, the present invention will be described as a timing device as used in a supervisory capacity with children, automatically keeping track of a discrete number of time intervals after which a specific function must be done; most particularly, a child would be reminded to return home from play after the device times out and emits an audible tone, or "beep". The number of time intervals would be entered through an electrical pushbutton by the parent into a programming circuit, each depression of the button being worth a specific interval of time. The time intervals so programmed are accumulative up to designed capacity of the device. Furthermore, the invention includes a lockout circuit which, after a short predetermined interval of time, precludes any modification of the program introduced by the programming circuit. This feature allows the initiator of the programming (the parent) to quickly input a short series of pushbutton closures in rapid succession which then effect a long timeout. For instance, if each of the input pushbutton closures represents one half-hour, then five quick depressions of the programming pushbutton would yield a 2.5 hour timeout before the beep. The lockout circuit functions so that during all but the first thirty seconds of the timeout period, the programming circuit would be locked out from further programming. Thus, the child could not increase the available time for play by subsequent activation of the pushbutton.

In use, the device could be packaged in a small portable enclosure such as a conventional wristwatch, a locket or pendant, adapted to be worn by a child. The only control device which need protrude from the package is the programming pushbutton. The device could be adapted to be powered by an electronic wristwatch battery which is replaced no more often than it would be in such a wristwatch. Because the electronic circuitry is adapted to be made from CMOS logic elements which draw an extremely small amount of power, no power on/offswitch would be necessary.

Applicant has conceived for this purpose an electronic circuit arrangement which consists of the following major functional blocks: an oscillator for timebase reference; a frequency divider which counts a particular number of the timebase oscillator pulses to provide a series of slowly changing pulses at the interval rate (e.g. 0.5 hour); the programming pushbutton debounce circuit; and up/down counter which counts the programming pulses up to the maximum designed capacity, and then counts down to zero at the slow interval rate, providing a signal at the end of the count down; a monostable multivibrator or one shot paired with an audio oscillator which provides the beep signal for a specific time; and the lockout circuit, which provides the disabling feature for further input programming from the programming pushbutton.

When the parent wishes to use the timer device, the parent merely depresses the programming pushbutton once per increment of the basic time period (typically one-half hour) desired for the child to be at play, after which the parent expects the device to sound the "beep" signal. The parent has, of course, instructed the child to return when the beep signal occurs. During the first 20 to 30 seconds after the initial pushbutton depression producing a programming pulse, the device accepts subsequent programming pulses to activate a counter up to the designed time interval accumulations capacity of the device. If desired, a liquid crystal display could be positioned on a viewing surface of the device and indicate the number of hours to which the device has been programmed before the device will beep. This display needs be only three digits to show XX.X hours. The act of depressing the programing pushbutton releases the lockout logic function which has been keeping the timebase oscillator turned off. The timebase oscillator then starts and its output now provides pulses to the frequency divider. Every basic interval period which appears at the output of the frequency divider is counted down by the up/down counter. After 20–30 seconds from the initial programming pushbutton depression, a signal from the frequency divider (which has a multiplicity of outputs from the initial input frequency to the basic time interval) is asserted which sets the lockout circuits, which now prevents any further input pulses from the programming pushbutton, effectively preventing anyone, either accidentally or intentionally, from changing the initial program setting until the entire programmed time has elapsed. A zero detector in the up/down counter constantly monitors the counter output for the zero value. When this zero value is reached (after the preprogrammed number of basic intervals input by the programming pushbutton) the zero detector output becomes true, signaling the beep circuit to activate the alerting audio tone for the child and also resetting the timebase circuit and the frequency divider circuit. At this time, the lockout latch is also reset so that it will allow the cycle to begin again. A further feature of the device is an additional time element from the output of the zero detector that waits until the end of the beep signal before resetting the lockout latch, so that the child cannot immediately reprogram the device for more time once the beep signal begins to sound.

DESCRIPTION OF THE PREFERRED EMBODIMENT

Figure 1:
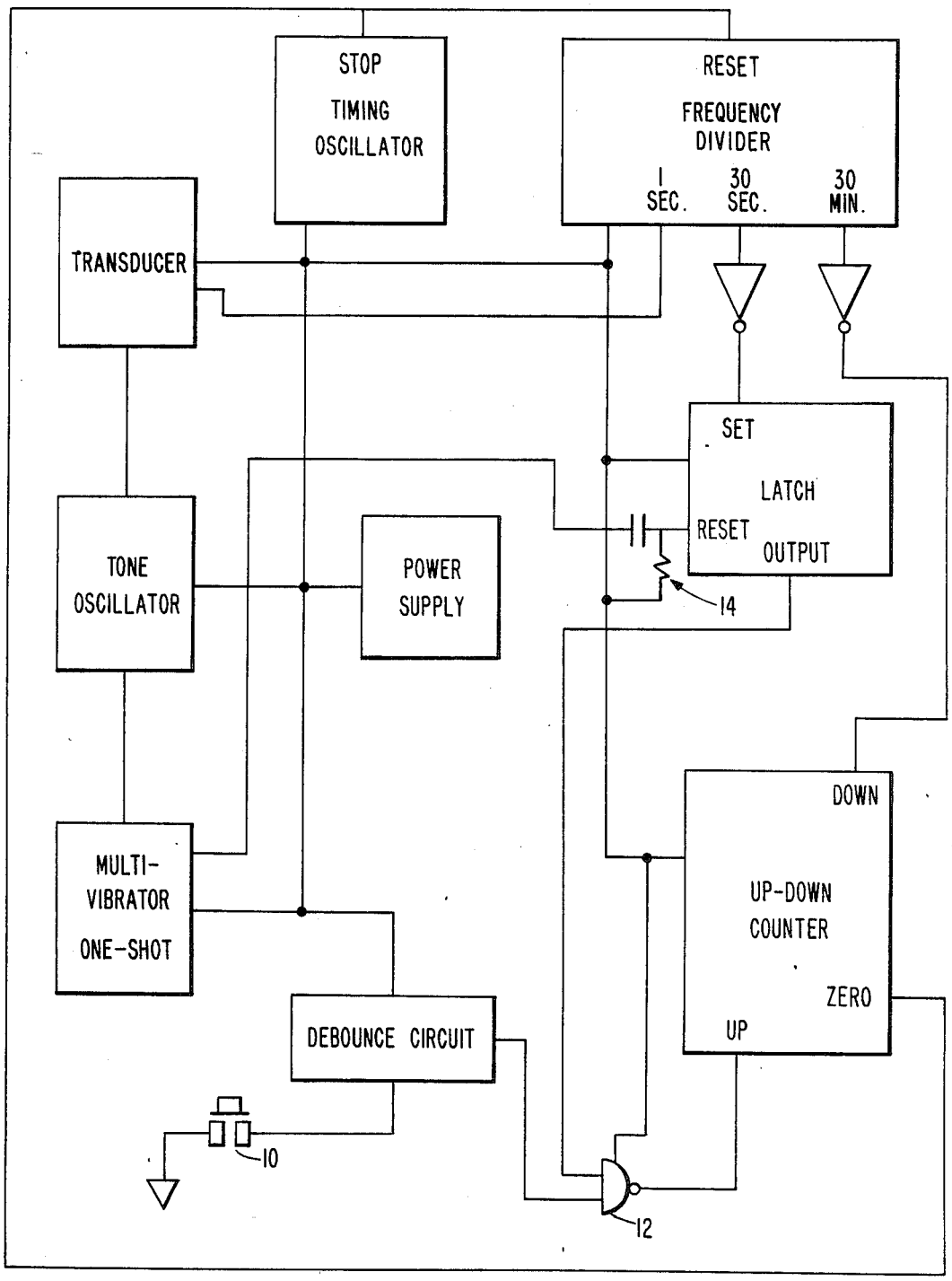
FIG. 1 is a schematic of the primary circuit showing all major electronic elements of the invention.

Referring to FIG. 1, power is supplied to all elements of the circuit by a wristwatch battery of conventional means and, like a wristwatch, power is constantly applied thus eliminating the need for a power switch. A timing oscillator is held reset by the zero output of the up-down counter (mentioned hereinbelow) and, when said reset is removed by a first programming pulse entered by the parent, generates a train of clockpulses which enter the frequency divider. The purpose of divider is to divide down the higher frequency oscillation into a series of slowly occurring pulses as a means of obtaining different time delays. As shown, there are outputs for time delays of one second, 30 seconds and one-half hour. A specific chip which has this division function is a CD4020 CMOS type implementation having 14 stages of ripple-carry flip-flops. The one-half hour output of said frequency divider is fed to a counter which is preferably a four or more bit up-down counting device. The purpose of the counter is to count up the pulses input by the parent over a device programming period and then to count down the same number of pulses over the longer period provided by the one-half hour output of the frequency divider. The counter has a zero detector which provides a low-true logic level when the binary value of the counter has reached zero. The counter is programmed up using a programing switch 10.

The programming switch 10 is connected to a debounce circuit whereby noise on the leading and trailing edge of the closure is removed through conventional means and is fed to the input of a NAND gate 12. The 30 second output from the frequency divider is adapted to go true after the initial programming pulse has released the reset on the oscillator. This true level is inverted using a 74C04 or equivalent logic device and is fed to the "set" input of a bistable latch, whose low true logic output (labeled LOCKOUT*) is fed to and activates said NAND gate 12, whereupon the any further input pulses provided by anyone depressing the programming switch 10 are logically locked out and effectively presented from entering the up-down counter. Therefore, the up-down counter now will only receive down-count input pulses at the one half hour frequency of the basic timing interval from the frequency divider. This means that when the parent programs the device, after 30 seconds or some other design-selectable short interval, the child or other user cannot change the programmed count.

At the time the down counter reaches the value of zero, after having cycled through the preprogrammed number of half-hour intervals, the zero detector output of the counter goes to a logic low-true state. The zero detector output is fed to the RESET input of the latch through a capacitive differentiation circuit 14, which generates a low going pulse at the trailing edge or end of the beep enable period. By making the beep enable period long, it is possible to design a delay to the point at which the circuit will be again ready for programming. This differentiated pulse then clears the latch which removes the lockout imposed on the NAND gate 12, preparing the programming circuit for its next use. Simultaneously, said low-true signal from the zero detector now is fed to the timing oscillator and causes it to stop. Except for the audio tone generator circuitry which now produces the "end of playtime" tone, the CMOS circuitry is now in a state of static inactivity. In this mode the circuitry uses an extremely small amount of electrical power there by allowing the entire circuit to be powered by a wristwatch battery for the same period of time as a typical digital wristwatch.

The low-true output from the zero detector of the down counter is also fed to the input of a tone oscillator. The tone oscillator is enabled by a monostable multivibrator, or one-shot circuit, whose duration is short relative to the basic time interval of the count down circuit. During the short time duration the tone oscillator which is a CMOS audio frequency oscillator, is enabled which drives one side of a two terminal crystal audio transducer providing the audible "beep".

During the countdown period, the audio transducer can be made to "click" by having the one second output from the frequency divider fed to the other side of the two-terminal audio transducer. During the countdown period, the transducer will see on the other side a pulse train provided by said one second output, while the first side of the transducer will be held low by the disabled tone oscillator. Since the crystal of the transducer is a high impedance device, it acts as a capacitor and differentiates the leading edge of the one second pulse, dissipating said pulse's energy as an audible "click". This "click" provides a ticking sound which indicates to both the child and the parent that the device is working. This ticking sound consumes very little power because of the high impedance of the crystal of the transducer, which draws very little current based upon the actual small capacitance of the device. An additional advantage of this "click" feature is that it continues during the audible tone generation, thereby providing a more arresting "beep" due to the variable modulation and the imbedded "click" noise.

The up-down counter can be a conventional CMOS 74C193 or the like. The invention does not depend upon the 4 stage setup of the 74C193, and can be expanded up or down to practical limits (including the ability of the package to accommodate the microelectronics). The latch can be a cross-coupled set of NAND gates, 74C00 or equivalent, or could be a set-reset type flip-flop, such as a CD4011. The debounce circuit is a capacitive filter on the input of a schmitt trigger inverter, such as a 74C14 or equivalent. It is within the scope of the invention to integrate all these elements into a CMOS gate array such that the entire circuit is produced on one die, leading to economies of scale which lower the cost of production.

Figure 2:
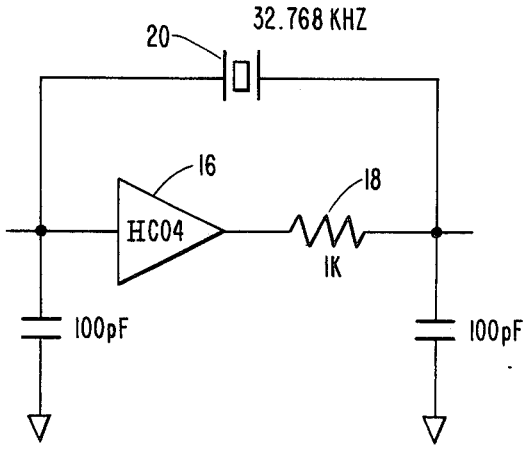
FIG. 2 is a detail of the tone oscillator.

The timing oscillator could be a 32.768 kilohertz crystal driving a simple inversion gate equivalent to a 74C04, although any modular osciallator could be used in this configuration and would perform satisfactorily. More specifically, the time oscillator could comprise, as shown in FIG. 2, a 74C04 inverter 16 using a current limiting resistor 18 driving a 32.768 kilohertz crystal 20. The purpose of the crystal 20 is to provide a stable oscillation frequency brought about by the fact that the crystal 20 has its lowest impedance to current flow at the resonant frequency and thus the best feedback for the sustaining of oscillation is at that frequency. The resistor 18 limits the drive capability of the inverter 16, preventing the resonant circuit from oscillation at multiple harmonics of the primary resonant frequency. The capacitive elements shown are part of the roll-off, and limit the ability of the inverter 16 to oscillate at higher frequencies.

Figure 3:
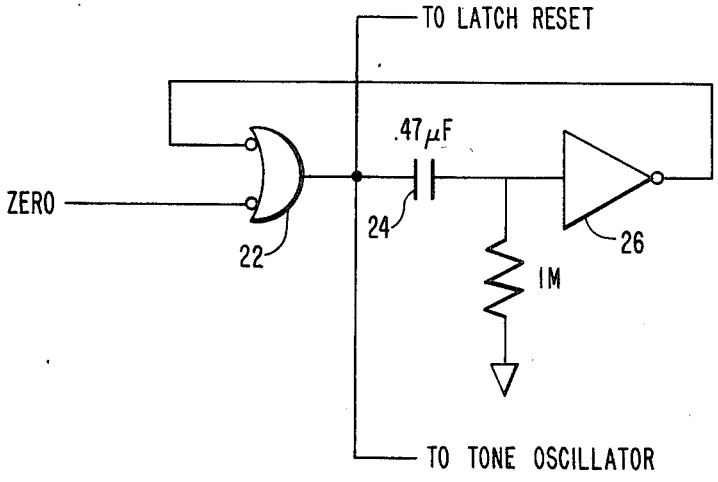
FIG. 3 is a detail of the one-shot or multivibrator.

In the one-shot or monostable multivibrator shown in FIG. 3, the zero detector output of the up-down counter of FIG. 1 is fed to the input of a NOR gate 22 (actually made from a NAND gate). The low-going signal causes the output to go high and said high signal being fed through a capacitor 24 which differentiates it providing a transient pulse at the input of the inverter 26 which follows. The output of the inverter 26 is fed back to the input of the NOR gate 22 so that while the capacitor 24 is passing the positive diffferentiated pulse, the high output of the NOR gate 22 will be sustained, allowing the original zero detector input signal to go away, having served as the trigger pulse. The output of the NOR gate 22 is positive true during the time constant for the RC network and is then passed on to the tone oscillator to enable the audible tone which is generated to create the beep effect, which beep effect indicates that the countdown interval is over.

It should be readily apparent that various changes in the components, and in the arrangement thereof, may be made to the above described embodiment without departing from the spirit and contemplation of the present invention which is intended to be limited in scope only by the appended claims.

I claim:

1. In an improved programable timing device, having a programming circuit, a timing circuit, a signal circuit, and a source of electrical power connected to the electrically functioning elements of said circuits:

(a) said programming circuit including an up-down counter having an input terminal and a zero detector terminal, a programming switch connected to the input terminal of the counter and adapted to program and counter up by introducing pulses thereto, and a NAND gate in said connection between said switch and counter;

(b) said timing circuit including a timing oscillator and a frequency divider, the output of said timing oscillator being connected to the input of said frequency divider, said frequency divider having a plurality of outputs, each output being a different multiple of the frequency of the timing oscillator, one of said frequency divider outputs being connected to said up-down counter and adapted to down count said counter;

(c) said signal circuit having an input connected to said zero detector terminal of said counter and adapted to be activated when said counter counts down to zero from pulses received from said one of said frequency divider outputs;

(d) the improvement comprising a lockout circuit adapted to disable said programming circuit after a selected interval of time, said lockout circuit including a latch having an input and an output, the input to said latch being connected to a second output of said frequency divider representing said selected interval of time, and the output of said latch being connected to said NAND gate in said programming circuit.

2. The device as defined in claim 1, wherein said zero detector terminal of said counter is also connected to said frequency divider and to said timing oscillator, whereby said timing circuit is deactivated when the counter counts down to zero.

3. The device as defined in claim 1, wherein said signal circuit includes a monostable multivibrator connected to said zero detector terminal of said counter, a tone oscillator connected to the output of said multivibrator and activated thereby, and an audio transducer activated by the output of said tone oscillator, said multivibrator having an output connection to said latch to reset said latch after said multivibrator has functioned.

4. The device as defined in claim 3, including a third output on said frequency divider producing a short periodic pulse, said third output being connected to said transducer to produce periodic audible signals during the timing interval of the device.

* * * * *